United States Patent [19]

von Lange

[11] Patent Number: 4,967,954

[45] Date of Patent: Nov. 6, 1990

[54] RAIL FASTENING DEVICE

[75] Inventor: Hans von Lange, Stewartstown, Pa.

[73] Assignee: American Track Systems, Inc., Shewsbury, Pa.

[21] Appl. No.: 284,500

[22] Filed: Dec. 15, 1988

[51] Int. Cl.[5] ..... E01B 9/48; E01B 9/30

[52] U.S. Cl. ..... 238/310; 238/282; 238/331; 238/348; 238/349; 238/351

[58] Field of Search ..... 238/310, 315, 316, 338, 238/339, 340, 341, 342, 343, 346, 347, 348, 349, 351, 352, 354, 355, 377, 331, 382, 287, 264, 265, 282

[56] References Cited

U.S. PATENT DOCUMENTS

| | | | |
|---|---|---|---|
| 902,757 | 11/1908 | Nevins | 238/343 |
| 1,222,811 | 4/1917 | Snyder | 238/351 |
| 1,237,863 | 8/1917 | Bodine | 238/351 |
| 1,845,912 | 2/1932 | Gilbert | 238/338 |
| 2,387,009 | 10/1945 | Clarkson | 238/349 |
| 2,579,373 | 12/1951 | Edee | 238/346 |
| 3,326,466 | 6/1967 | Sanson | 238/349 |
| 3,576,293 | 4/1971 | Landis et al. | 238/310 |
| 3,934,800 | 1/1976 | Molyneux | 238/282 |
| 4,325,510 | 4/1982 | Sherrick | 238/341 |
| 4,326,670 | 4/1982 | Sherrick et al. | 238/349 |
| 4,349,151 | 9/1982 | Schumaker | 238/355 |
| 4,718,604 | 1/1988 | Eisenberg et al. | 238/349 |

*Primary Examiner*—Andres Kashnikow
*Assistant Examiner*—Mark T. Le
*Attorney, Agent, or Firm*—Thomas P. Liniak

[57] ABSTRACT

An adjustable rail seating and fastening device that maintains and adjusts gauge of a rail and secures a rail to a rail support or tie plate, positively engages the rail support at both ends of the device, and provides a biasing element to maintain the engagement between the device, the rail support and the rail.

17 Claims, 5 Drawing Sheets

RAIL FASTENING DEVICE

BACKGROUND OF THE INVENTION

This invention relates to an improved rail seating and fastening device. More particularly, this invention relates to an improved adjustable, relatively (substantially) maintenance-free rail fastening device that provides for firm engagement of both end portions of the device.

Rails used in the construction and operation of modern railway systems are constantly subjected to strong forces and loadings during their useful lives. Since several tons of machinery, as well as millions of dollars of goods and equipment and countless human lives pass over these rails every day, it is understandably of prime importance that the rails remained at all times in a stable, substantially stationary and structurally rigid condition.

Although the rails themselves are generally of a substantially stable construction, they are laid down in continuous or semi-continuous sections. In use, these rails are subjected to a number of external forces not the least of which is a train or similar vehicle rolling over the track. These external forces have the tendency of introducing a great degree of travel into an unrestrained rail, potentially resulting in derailment and disaster. For that reason, attempts have been continuously made to provide devices that positionally stabilize the rails by fastening them to rail supports or tie plates.

The prior art devices have been of two general types, the first type of device being a mechanical holder construction that attempts to catch the edge of one flange of the rail under the holder and then bolt the holder to the rail support or tie plate. Other devices have utilized a spring clip construction that has contacted only the inner surface of one flange of the rail, at a distance somewhat inward from the edge of the flange. These devices depend upon the torsional or bending moment force of the arm of the clip to exert a force on the horizontal plane of the fastening device, as well as on the rail, to positionally stabilize both. These devices have likewise depended upon threaded fasteners to engage and secure them to rail supports and tie plates.

The problem inherent with such structures is that forces encountered can be of such a magnitude as to loosen, strip or sheer such threaded fasteners, resulting in a system failure. Modern rail technology has made the ability to accommodate different gauge rail stock a necessity. Existing rail fastening devices have usually been either unadjustable or have necessitated a loosening and tightening of a threaded element to accomplish this result. Even those devices that have been capable of adjustment have suffered a resultant weakening of the threaded elements, through successive loosenings and tightenings.

SUMMARY OF THE INVENTION

It is, therefore, an object of the invention to provide a rail fastening device capable of positive engagement of both ends of the device.

Another object of the invention is to provide a rail fastening device that also utilizes a spring clip that acts on a vertical plane of the fastening device and on the rail itself.

Yet another object of the invention is to provide a rail fastening device that does not require the use of threaded fasteners.

Still another object of the invention is to provide a rail fastening device that is adjustable to accommodate different-sized rails without requiring the use of threaded connecting elements.

These and other objects are satisfied by a device for fastening a rail, comprising a base having an aperture and first and second surfaces, said first surface having a first engaging member projecting substantially vertically therefrom and said second surface having serrations that engage one rail support side and a second serrated member projecting from said second surface that engages the other side of the rail support, and a biasing member having first and second ends, said first end being fixed in said aperture and exerting a force thereon, said second end being in connection with the rail and exerting a force thereon, said biasing member being in connection with said first engaging member between said first and second ends and exerting a force thereon.

The invention will now be described with respect to certain embodiments, as illustrated in the following drawings.

DETAILED DESCRIPTION OF THE INVENTION

Figure 1:
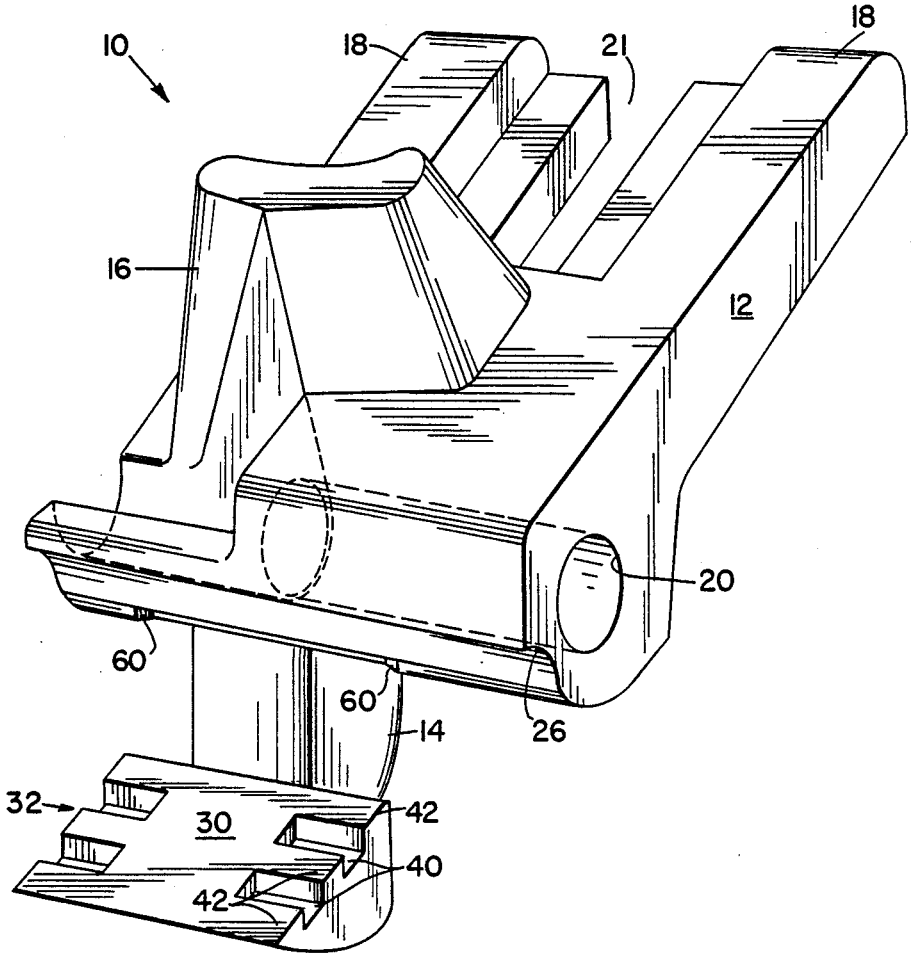
FIG. 1 is a perspective view of the present invention.

Referring to FIGS. 1–4, device 10 and its major structural features are shown. Device 10 is used to secure and to hold gauge of rail 28 to rail support, referred to generally as 38. Device 10 is designed to be used in tandem with one each at either flange 48 of rail 28, or it can also be used singly in conjunction with a prior art fastening device. Rail support 38 is of a construction well-known in the art, with serrations 36 and 44 being added to its surface.

Figure 2:
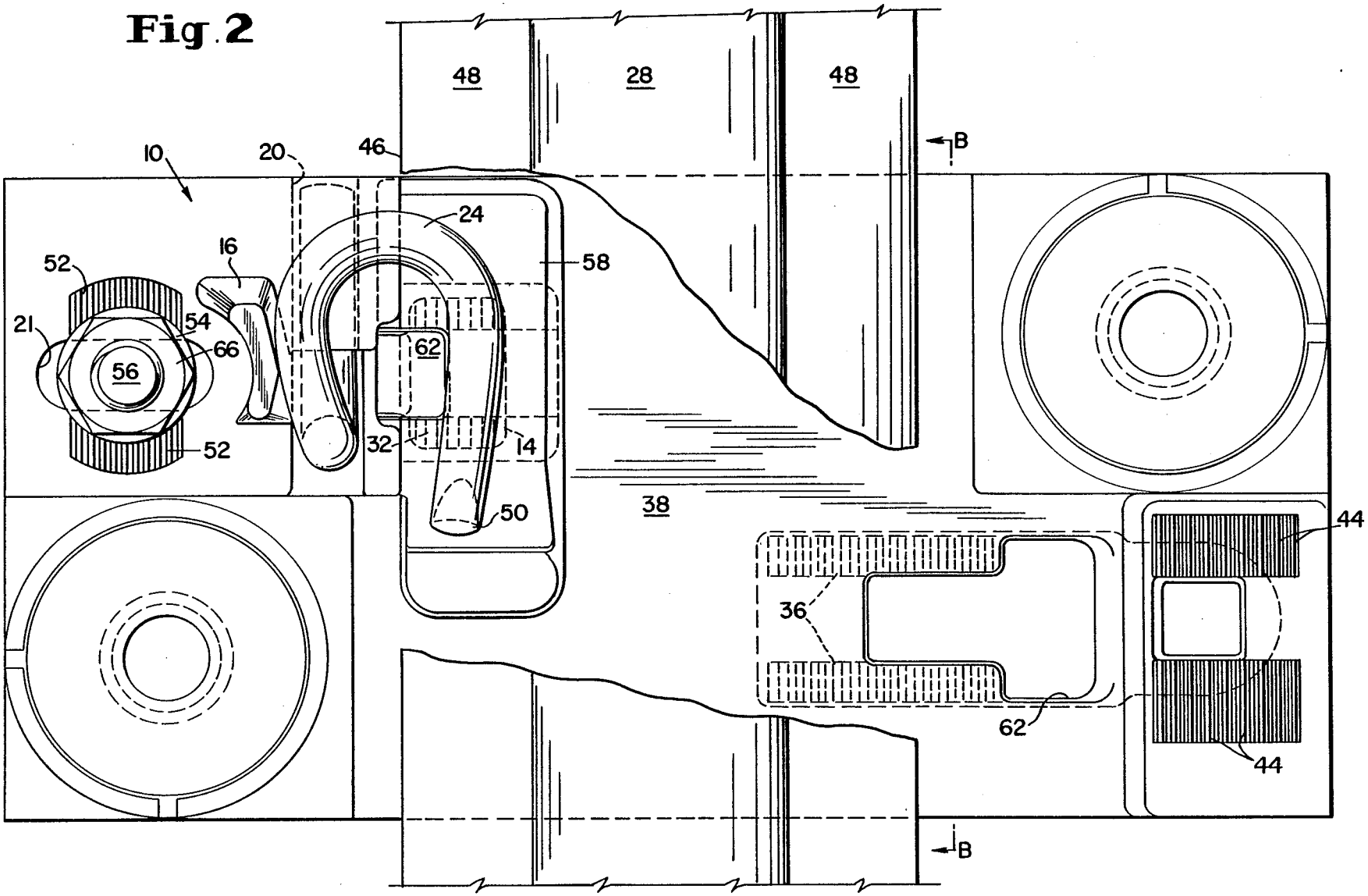
FIG. 2 is a top view of the present invention.
Figure 3:
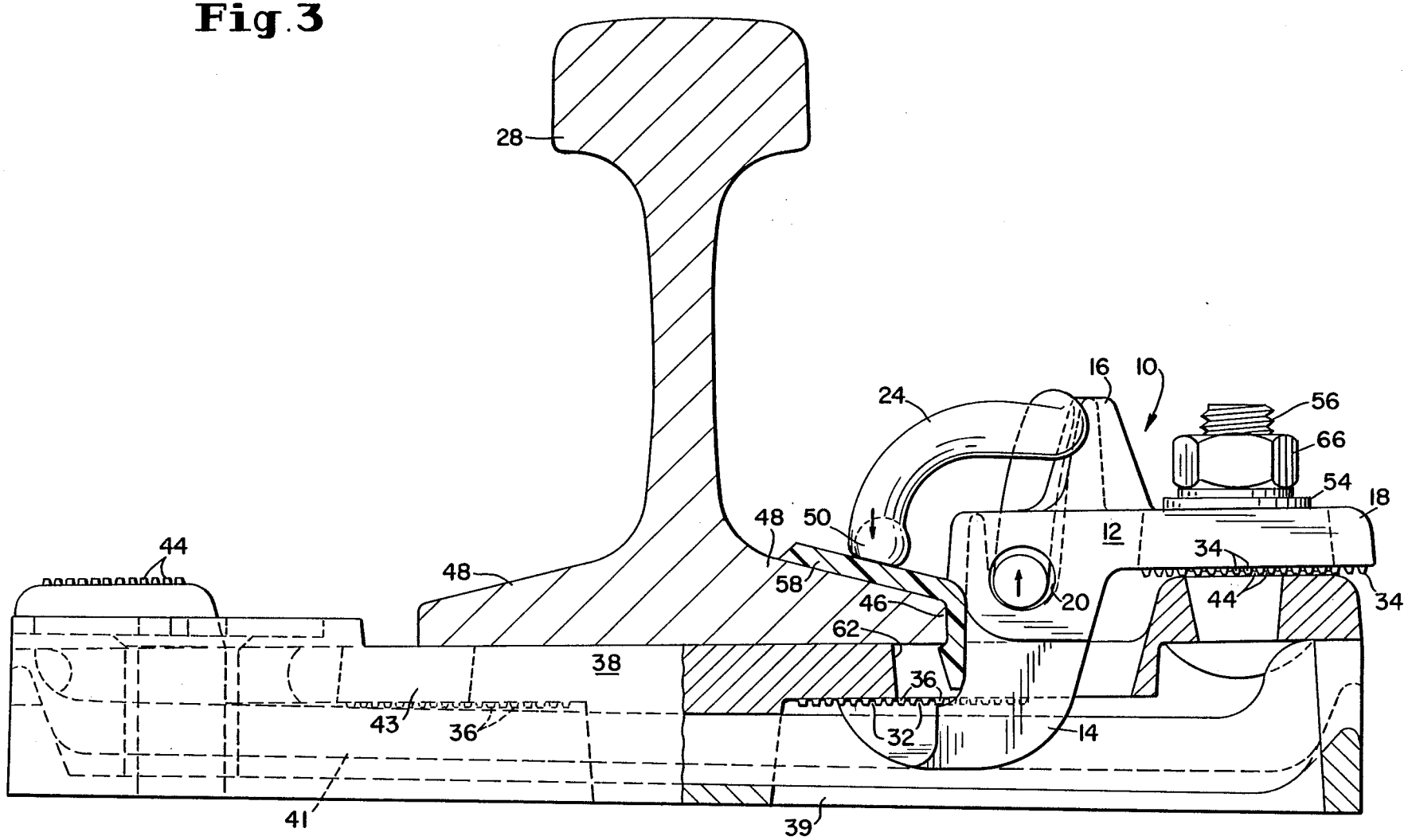
FIG. 3 is a side view of the present invention shown as it would appear in use, fastening a rail in position.
Figure 6:
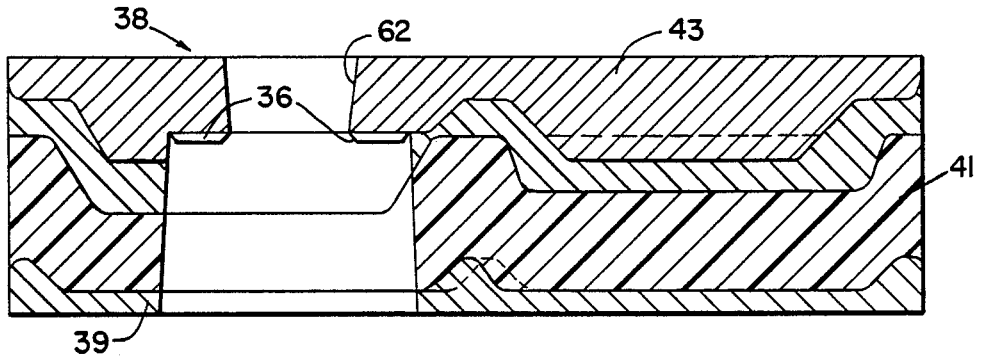
FIG. 6 is a cross-sectional view of the rail support, according to the present invention, taken along the line B—B of FIG. 2.

Referring to FIGS. 2, 3 and 6, it is readily apparent that rail support 38 spans under and extends beyond flanges 48 of rail 28. Rail support 38 contains base plate 39, resilient liner 41 and support member 43. Base plate 39 and support member 43 must possess a high degree of tensile strength, and are, therefore, usually constructed of ductile iron or rolled steel. Resilient liner 41 lessens translation of forces between base plate 39 and support member 43, and is formed of an elastomeric or similar compound that exhibits a high degree of resiliency. Support member 43 has serrations 36 and 44 formed into or attached to its under surface and top surface, respectively. Rail support 38 also features opening 62 through which lower engaging member 14 is passed.

Body 12 of device 10 has a substantially rectangular cross-sectional shape, with lower engaging member 14 integral with and projecting from the lower surface of body 12, and upper engaging member 16 projecting upwardly from top surface of body 12. The rear-end of body 12 has dual projecting members 18 of stepped construction which form slot 21 between them. Body 12 also features aperture 20 that houses and engages one end of spring clip 24 in the manner shown in FIG. 3. Lower front edge of body 12 has recess 26 along its entire length to allow device 10 to catch and retain an edge of one flange 48 of rail 28.

During use, device 10 is subjected to external forces of high magnitude, as a result of its connection to rail 28. Structural integrity of device 10 is therefore of primary importance. Device 10 is intended to be of a one-piece construction of cast iron, steel or forging. Outer surfaces of device 10 are generally flat and smooth, except for upper surface 30 of lower engaging members 14 which has serrations 32, and under surface of body 12 which has serrations 34. Additionally, upper surface of dual projecting members 18 may optionally be serrated (see FIG. 2) if an additional connection to rail support is desired.

Figure 4:
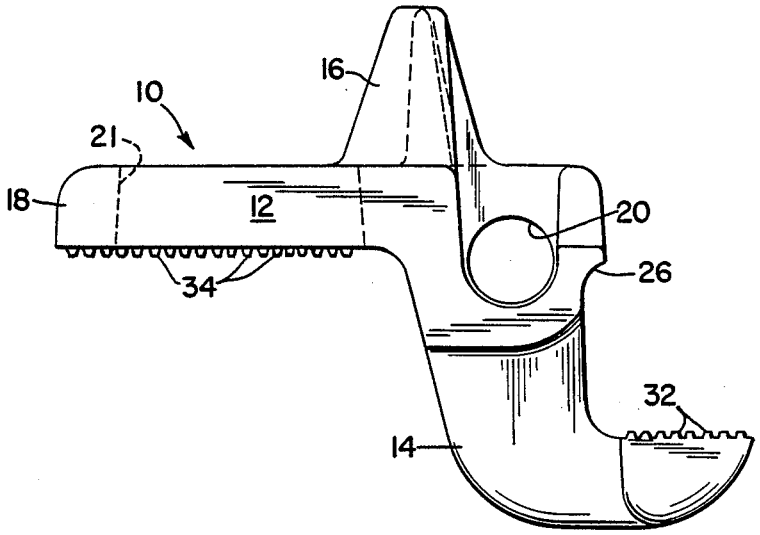
FIG. 4 is a side view of the present invention.
Figure 5:
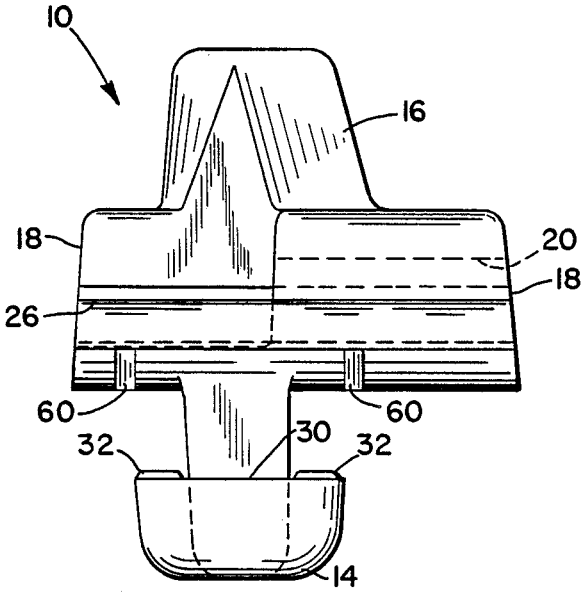
FIG. 5 is a rear view of the present invention.

Reference is now particularly made to FIGS. 1,3 and 4, and how device 10 is used to fasten rail 28. As previously described, upper surface 30 of lower projecting member 14 has serrations 32. Serrations 32 can alternatively extend over a portion of the length of surface 30 as shown in FIG. 1, or can extend in a continuous manner over entire top surface 30. Different pitch, numbers and widths of serrations are usable, depending upon the particular use device 10 is to be subjected to. It has been found, however, that a depth of around ⅛ of an inch is generally preferred with a minimum of three teeth 42 providing engagement.

Teeth 42 and depressions 40 of serrations 32 mesh with and positively engage like serrations 36 on the bottom surface of rail support or tie plate 38, as shown in FIG. 3. As can readily be appreciated, this engagement effectively prohibits movement of the front end of device 10 in the horizontal plane or the direction perpendicular to the normal force. Lower engaging member 14 is generally provided with more than three engaging serrations 32, so that it can be adjusted horizontally along bottom surface of rail support or tie plate 38 to accommodate different gauge rail stock while still maintaining positive engagement of at least three serrations 32.

Turning now to the undersurface of body 12, serrations 34 are of similar pitch and type as serrations 32 of lower engaging member 14. Serrations 34, like serrations 32, can also be continuous along the entire length of under surface of body 12, or discontinuous. Serrations 34 must be of same type, pitch and size, however, as serrations 32, to allow device 10 to be adjusted in the horizontal plane to accommodate different gauge rails. Serrations 34 must have an engagement length of at least three inches to be effective, but could also run the entire length of under surface of body 12. Serrations 34, as more clearly seen in FIG. 3, mesh and positively engage serrations 44 on top surface of rail support or tie plate 38 to prevent movement of the rear end of device 10 in the horizontal plane. In this manner both ends of device 10 are provided with a firm engagement of serrations 36 and 44 of tie plate 38, further preventing movement of device 10 in the horizontal plane, thereby restricting horizontal travel of rail 28.

Device 10 not only provides for restriction of travel of rail 28 in the horizontal plane, but also provides a dual mechanism for restricting rotational movement of rail 28. Longitudinal recess 26 catches and holds edge 46 of flange 48 of rail 28 along the entire length of body 12. In this manner recess 26 restricts rotational movement resulting from external forces such as a torsional loading on rail 28 or train traveling over rail 28.

Additionally, spring clip 24 works to create forces that restrict both rotational and horizontal travel of rail 28. Aperture 20 provides housing for one end of spring clip 24, and spring clip 24 is removably secured therein. As shown in FIG. 3, spring clip 24 extends outwardly of aperture 20, engages against surface of vertical engaging member 16 opposite end 50. Spring clip 24 then extends toward and engages flange 48 of rail 28 at a distance away from edge 46. End 50 of spring clip 24 exerts a downward biasing force on flange 48 and resists both upward and rotational movement of rail 28. There are several spring clip constructions currently available that can provide the necessary biasing forces, the known preferred clips are being marketed by Pandrol, Inc. under the trademark PANDROL, and by VOSSLOH under the trademark VOSSLOH VHT. Spring clip 24 serves a very important function in the overall fastening system of device 10. As shown by the directional arrows in FIG. 3, clip 24 exerts a downward biasing force on the surface of vertical engaging member 16 which constantly urges serrations 34 on under surface of body 12 into contact with serrations 44 on top of tie plate 38. Clip 24 also exerts an upward force at aperture 20 which constantly urges serrations 32 of lower engaging member 14 into contact with serrations 36 of bottom surface of tie plate 38. As previously described, clip 24 exerts a third force, a downward force at its end 50 on flange 48 which assists in keeping rail 28 seated in recess 26. Clip 24 could be replaced by any device capable of exerting similar forces. Similarly, vertical engaging member 16 is not restricted to a given critical angle and will translate biasing force from spring clip 24 to body 12 over a wide range of substantially vertical angles.

Figure 7:
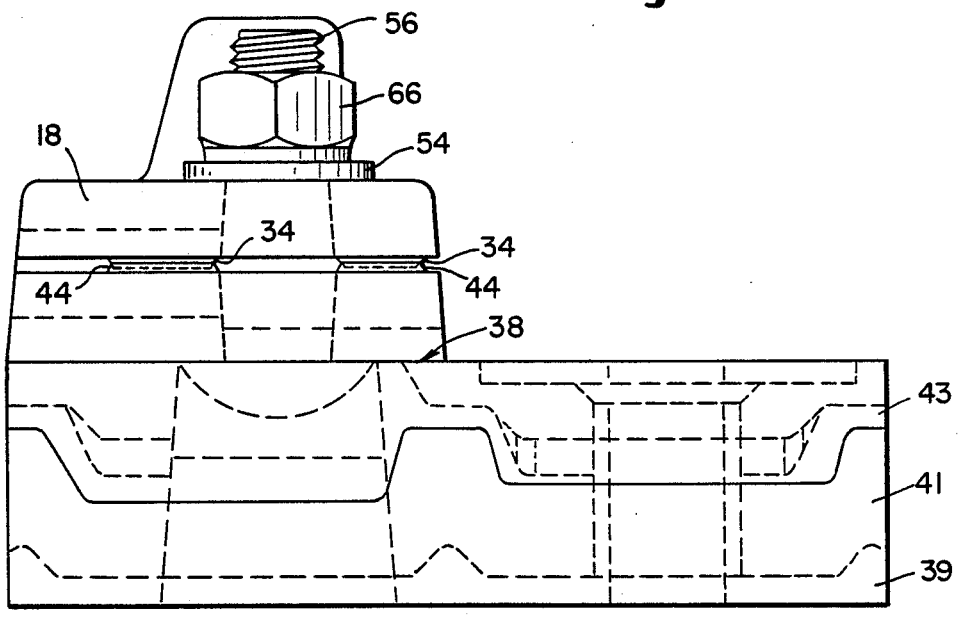
FIG. 7 is a side view of the device utilizing an alternative fastening mechanism.

Other features can be built into device 10 to increase the strength of its connection or to create fail-safe mechanisms. Device 10 can be modified, such that slot 21 is closed and dual projecting arms 18 are joined in one piece at rear of device 10, to impart a higher degree of structural rigidity, as shown in FIG. 2. Additional serrations 52 can be provided on top surface of arms 18 (see FIG. 2) in order to mesh with and engage serrated washer 54, nut 66 and bolt 56 or similar connecting device, as shown in FIGS. 3, 4 and 7. Bolt 56 would be sunk through to slot 21 (see FIG. 7), into and attached to tie plate 38, to provide yet another point of attachment for device 10 to tie plate 38 that would restrict movement of device 10 in the horizontal and vertical planes, as well as rotational movement.

If it is desired to reduce the magnitude of forces translated from rail 28 to device 10, rather than strictly counteracting them, resilient insert 58 (see FIG. 3) can be used in recess 26. Insert 58 is designed to be of shape sufficient to mate with surface of recess 26, and extends longitudinally along recess in region between bosses 60 (see FIG. 1). Insert 58, also projects outwardly over flange 48 where it lessens translation of forces to spring clip 24. Bosses 60 prevent insert 58 from sliding longitudinally. Alternatively, longitudinal travel of insert 58 could be restricted by engaging insert in opening 62 of rail support 38. Insert 58 is preferably constructed of a thermoplastic material having sufficient resiliency to lessen the translation of forces between rail 28 and device 10, while at the same time being relatively resistant to heat, cold and other weather conditions.

Once given the above disclosure, many other features, modifications and improvements are thus to be considered a part of this invention, the scope of which is to be determined by the following claims.

I claim:

1. A device for maintaining and adjusting gauge and for fastening a rail to a rail support having oppositely disposed sides comprising:

a base having an aperture and first and second surfaces, said first surface having a first engaging member projecting substantially vertically threrefrom and said second surface having at least two separate sets of serrations such that the first set engages one rail support side and the second set projects from said second surface an engages the other side of the rail support, and a biasing member having first and second ends, said first end being fixed in said aperture, said second end being in connection with the rail and exerting a force, said biasing member being in connection with said first engaging member between said first and second ends and exerting a force thereon.

2. A device as in claim 1, wherein:

said biasing member is a spring clip.

3. A device as in claim 1, further comprising additional means for connecting said device to said rail support.

4. A device as in claim 1, wherein said sets of serrations are discontinuous along said base.

5. A device as in claim 1, wherein said sets of serrations are continuous along said base.

6. A device as in claim 1, said base further comprising first and second ends, said first end having a longitudinal recess to hold the rail and said second end being slotted.

7. A device as in claim 6, further comprising additional means for connecting said slotted end to said rail support.

8. A device as in claim 7, further comprising a fastening means comprised of serrations.

9. A device as in claim 6, wherein said force exerted by said biasing member exerts a second force that causes said sets of serrations to engage said rail support sides and causes said recess to engage said rail.

10. A device as in claim 6, further comprising a resilient member connected to said recess.

11. A device as in claim 10, further comprising bosses located on said base to hold said resilient member.

12. A device as in claim 10, wherein said recess holds said rail to prevent substantial rotational movement of said rail about the longitudinal axis of said rail.

13. A device for maintaining and adjusting gauge and fastening a rail, comprising:

a rail support having oppositely disposed sides, each of said sides having serrations, a base having an aperture and first and second surfaces, said first surface having a first engaging member projecting substantially vertically therefrom and said second surface having at least two separate sets of serrations such that the first set engages one rail support side and the second set projects from said second surface and engages the other side of the rail support, and a biasing member having first and second ends, said first end being fixed in said aperture, said second end being in connection with the rail and exerting a force, said biasing member being in connection with said first engaging member between said first and second ends and exerting a force thereon.

14. A device as in claim 13, wherein said sets of serrations are discontinuous along said base.

15. A device as in claim 7, wherein said rail support further comprises a first plate, a second plate and a liner between said first and second plates, said first plate including an opening through which said second set of serrations passes.

16. A device as in claim 13, wherein said sets of serrations are continuous along said base.

17. A device as in claim 13, wherein said force exerted by said biasing member exerts a second force which causes said sets of serrations to engage said rail support sides and said recess to engage said rail.

* * * * *